US008579124B2

(12) United States Patent
Ferry

(10) Patent No.: US 8,579,124 B2
(45) Date of Patent: Nov. 12, 2013

(54) PRODUCT DISPLAY DEVICE

(75) Inventor: Vincent Ferry, Paris (FR)

(73) Assignee: Compagnie Gervais Danone, Paris (FR)

( * ) Notice: Subject to any disclaimer, the term of this patent is extended or adjusted under 35 U.S.C. 154(b) by 293 days.

(21) Appl. No.: 12/525,317

(22) PCT Filed: Dec. 20, 2007

(86) PCT No.: PCT/FR2007/002127
§ 371 (c)(1),
(2), (4) Date: Sep. 2, 2009

(87) PCT Pub. No.: WO2008/096057
PCT Pub. Date: Aug. 14, 2008

(65) Prior Publication Data
US 2010/0072148 A1 Mar. 25, 2010

(30) Foreign Application Priority Data
Jan. 31, 2007 (FR) ..... 07 00664

(51) Int. Cl.
*A47G 29/00* (2006.01)

(52) U.S. Cl.
USPC ..... 211/72; 211/126.16; 229/120.24

(58) Field of Classification Search
USPC ..... 211/59.2, 126.16, 85.4, 72, 73, 70.1, 211/85.18, 188, 194, 59.4; 206/736, 433, 206/593; 229/120.17, 120.24, 120.37, 229/120.32, 120.38
See application file for complete search history.

(56) References Cited

U.S. PATENT DOCUMENTS

| | | | | | |
|---|---|---|---|---|---|
| 2,252,235 | A | * | 8/1941 | Snelling | 294/87.2 |
| 2,314,491 | A | * | 3/1943 | Greenberg | 206/587 |
| 2,748,927 | A | * | 6/1956 | Crane, Jr. | 206/478 |
| 3,084,790 | A | * | 4/1963 | Lugt, Jr. | 206/562 |
| 3,184,148 | A | * | 5/1965 | Poupitch | 206/203 |
| 3,528,558 | A | * | 9/1970 | Williams | 211/59.2 |
| 3,737,094 | A | * | 6/1973 | Beaver et al. | 229/120.17 |
| 3,828,926 | A | * | 8/1974 | Rossi | 206/427 |
| 3,840,171 | A | * | 10/1974 | Waters | 206/562 |
| 3,884,354 | A | * | 5/1975 | Guenther et al. | 206/427 |
| 3,905,484 | A | * | 9/1975 | Dean et al. | 211/184 |
| 3,927,789 | A | * | 12/1975 | Prodel | 220/515 |
| 4,395,955 | A | * | 8/1983 | Pfeifer | 108/61 |
| 4,537,316 | A | * | 8/1985 | Simon et al. | 211/133.3 |
| 4,560,064 | A | * | 12/1985 | Peterson et al. | 206/159 |
| 4,848,648 | A | * | 7/1989 | Eisman | 229/114 |
| 4,905,889 | A | * | 3/1990 | Schuster | 229/120.17 |
| 5,597,070 | A | * | 1/1997 | Wu | 206/419 |
| 5,967,406 | A | * | 10/1999 | Moorman | 229/120.37 |
| 5,984,120 | A | * | 11/1999 | Johnske | 211/132.1 |

FOREIGN PATENT DOCUMENTS

| | | |
|---|---|---|
| DE | 295 05 720 | 7/1995 |
| EP | 0 343 113 | 11/1989 |
| FR | 2 112 304 | 6/1972 |
| FR | 2 749 831 | 12/1997 |
| FR | 2 862 615 | 5/2005 |
| WO | 97 30908 | 8/1997 |

* cited by examiner

*Primary Examiner* — Korie H Chan
(74) *Attorney, Agent, or Firm* — Oblon, Spivak, McClelland, Maier & Neustadt, L.L.P.

(57) ABSTRACT

A device for presenting products presenting at least two pots united by a connection region situated in their upper portions. The device includes a tray having a bottom and at least one separator wall against which the bottom face of at least one connection region comes to bear, the two above-mentioned pots being situated on either side of the separator wall.

17 Claims, 8 Drawing Sheets

PRODUCT DISPLAY DEVICE

The present invention relates to a device for presenting products presenting at least two pots united by a connection region situated in their upper portions.

Products such as yogurts are generally delivered to stores grouped together on card trays disposed on a pallet. Such grouping trays are generally very simple, comprising a bottom having an outline that is surrounded by a wall that serves to keep the products on the tray.

When the products are put onto shelves, they are taken out of the grouping trays and the trays are discarded. To save time when stocking the shelves, it can also happen that the grouping trays are placed directly on the shelves.

The above-mentioned products are usually presented to customers in card sleeves grouping them together in batches of two, four, eight, 12, or 16 units. These sleeves provide each batch with a certain amount of stability, making it easier to handle, which is particularly useful when stocking shelves. They are subsequently discarded by consumers.

This raises several problems.

A first problem is associated with the environment. To minimize the harmful impact of packaging, the governments of various countries are encouraging a reduction in the quantity of packaging and also the use of recyclable materials.

Thus, the card grouping trays, once emptied of their contents, are recycled by the distributors themselves, whereas the grouping sleeves are recycled at best by selective sorting of household waste which is a process that is more complicated. That is why the use of card sleeves is subjected to a specific tax known as "eco-tax" for contributing to financing their recycling.

A second problem lies in the presentation of products when the grouping card is put on the shelves. The presence of the card "hides" the products it groups together. Furthermore, when such cards have opening devices, they are poorly controlled and unsightly.

A third problem is associated with cooling for fresh products such as yogurt. Non-stirred yogurts are put into pots at 40° C. before the end of fermentation, so as to enable a gel to form (pH=4.5), and they are subsequently cooled down to 5° C. in a tunnel. Stirred yogurts are fermented in a vat, and then put into pots and cooled down to 5° C. in a tunnel. Either way, conventional grouping trays slow down cooling because of the walls formed around their peripheries. To reduce that drawback, it is known to perforate such walls to facilitate the flow of air.

A fourth problem lies in pots being stacked on pallets to heights of about 2 meters.

The grouping trays are stacked on one another via their bottoms that rest on the vertical walls forming the outlines of the trays, and above all on the products in the lower layer(s) that thus support the major fraction of the weight.

An object of the present invention is to provide a device for presenting products on the shelves of a store and that is suitable for avoiding at least one of the above-mentioned drawbacks.

The invention thus provides a device for presenting products presenting at least two pots united by a connection region situated in their upper portions, the device being characterized in that it presents a tray having a bottom and at least one vertical separator wall obtained by folding two regions of a blank together edge to edge and at 90°, the bottom face of at least one connection region coming to bear thereon, said two above-mentioned pots being situated on either side of the separator wall.

Advantageously, a said separator wall extends from a front edge to a rear edge of the tray, thereby contributing better to the ability of pairs of pots to withstand compression by carrying them in the middle over the entire length of the connection between pots.

The device may have a plurality of separator walls spaced apart by a distance corresponding to two cavities.

The products may be grouped together in multiples of two, in particular in groups of two, four, six, or eight pots disposed in one or more rows.

At least one separator wall may extend from one edge to the other of the blank.

The device is generally made from a single blank, in particular a card blank.

The bottom of the tray is advantageously bordered by a first wall suitable for retaining the products and running along a first side of the bottom.

Preferably, the first wall is extended in opposite directions by second and third walls that are adjacent thereto and that extend over a fraction of second and third sides adjacent to the first side, in particular over less than half the length of said second and third sides, and more particularly over about one-third of said length.

The device may be characterized in that the first wall is formed by folding a first flap that is hinged to first side of the tray and in that the second and third walls are formed by folding second and third flaps that are hinged to the second and third sides of the tray, which flaps may present respective backing flaps that partially overlie the first flap.

The device may include at least one retaining flap hinged to a said region folded together edge to edge and coming to bear against the first retaining region, such that by folding and sticking together three superposed flaps, the rear portion that is used for handling is reinforced, while ensuring that the blank can be cut out from a rectangle of optimum size.

At least one retaining wall may present at its bottom and top portions an extension and a cutout that are complementary and that co-operate when the products are stacked in superposition.

At least the bottom of the tray and at least one separator wall may present openings so as to facilitate air flow.

The invention can be better understood on reading the following description with reference to that accompanying drawings, in which:

FIGS. 1*a* and 1*b*, and FIGS. 2*a* and 2*b* are front and rear perspective views of first and second embodiments of a tray of the invention, in particular with a tear-off pot-retaining abutment;

FIGS. 3*a* and 3*b* show a presentation device comprising the tray of FIGS. 1*a* and 1*b* together with yogurt pots in four-pack (FIG. 3*a*—rear perspective view) or in groups of 8 (FIG. 3*b*—front perspective view);

FIGS. 4*a* and 4*b* show presentation devices of FIG. 3*a* respectively in a rear perspective view and a front perspective view with some of the products removed, FIG. 4*c* being an enlargement of a portion of FIG. 4*a* to show the region where the two trays interfit;

Figure 1A:
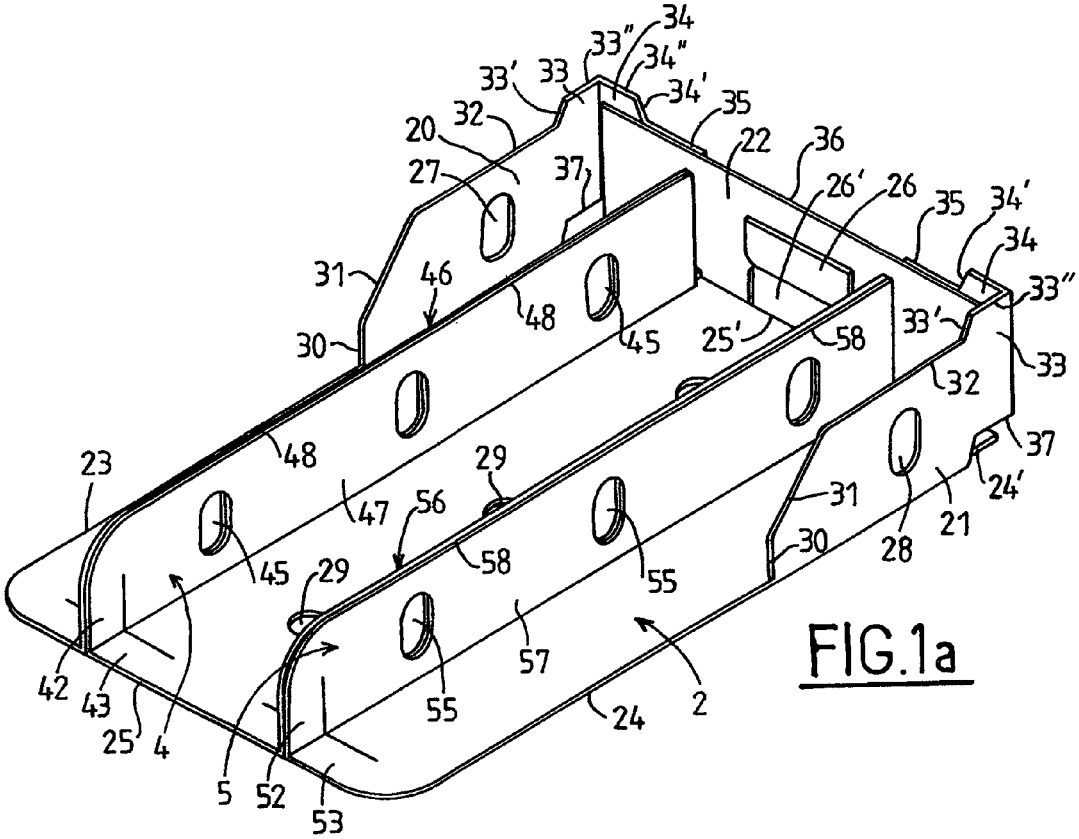
Figure 1B:
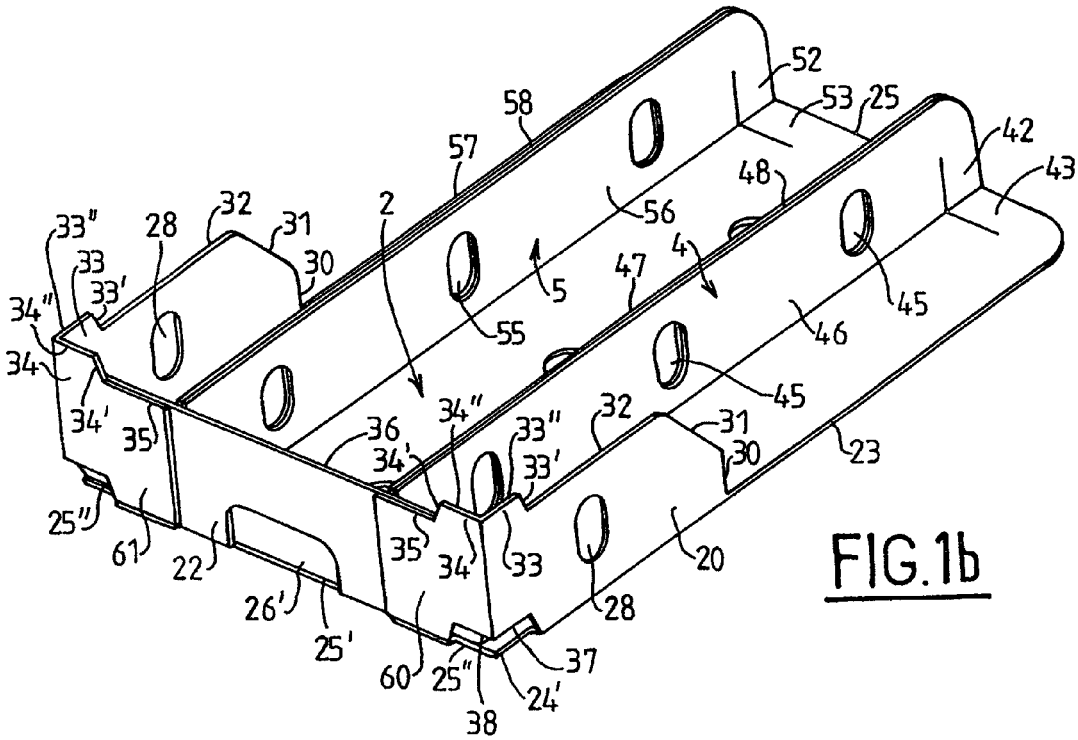

As shown in FIGS. 1*a* and 1*b*, a tray 1 has a generally rectangular bottom 2 and two separator walls 4 and 5 extending parallel to the sides 23 and 24, preferably between the front edge 25 and a rear wall 22. The rear wall 22 lies between two side walls 20 and 21 that are adjacent thereto and that extend over a fraction of the length of the two sides 23 and 24, here about one-third.

The rear wall 22 includes a handle opening 26' obtained by folding a cutout flap 26 through 90° and applying adhesive, thereby reinforcing this zone.

The side walls 20 and 21 present a top edge 32 that extends about one-third of the way along the sides 23 and 24 from the rear edge 25', and that extends forwards via a cut-off corner 31 and a vertical edge 30, and rearwards by a raised extension 33 defined by a cut-off corner 33' and a top edge 33".

In addition, the side walls 20 and 21 are extend by flaps 60 and 61 that cover the wall 22 and present a top edge 35 running along the top edge 36 of the wall 22, and a raised extension 34 defined by a cut-off corner 34' and a top edge 34".

The rear bottom portions of the side walls 20 and 21 present trapezoidal cutouts 37 that are complementary to the extension 33 and that are adjacent to trapezoidal cutouts 38 of the flaps 60 and 61 that are complementary to the extensions 34, these extensions and cutouts enabling the trays to be stacked in superposition while holding them one to another, also because of cutouts 24' and 25" in the sides 24 and 25'. Complementary extensions and cutouts may be provided in the flap 22, in particular in the absence of flaps 60 and 61.

Openings 26', 27, 28, 29, 45, and 55 are formed respectively in the wall 22 and/or the walls 20 and 21 and/or the bottom 2, and/or the separator panels 4 and 5 in order to improve, where appropriate, the flow of air for products that are subjected to a thermal step such as cooling. These openings are formed in the spaces 74 between the pots 72.

Figure 2A:
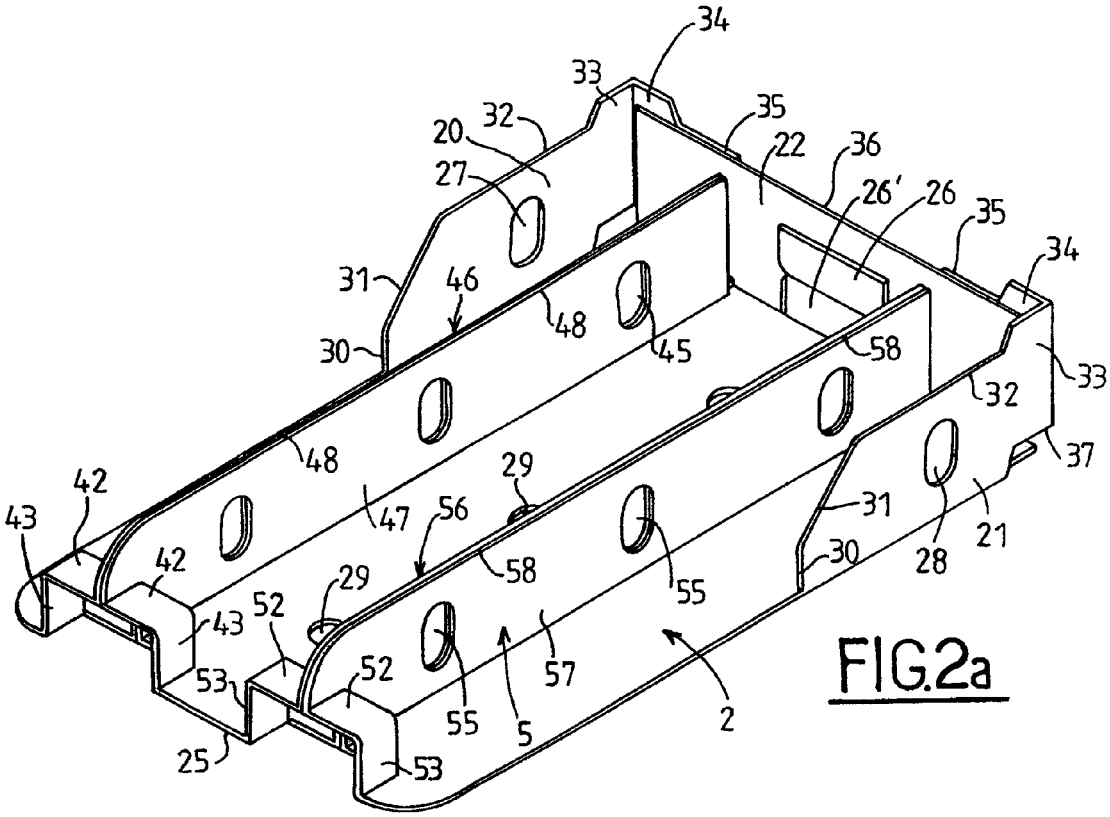
Figure 2B:
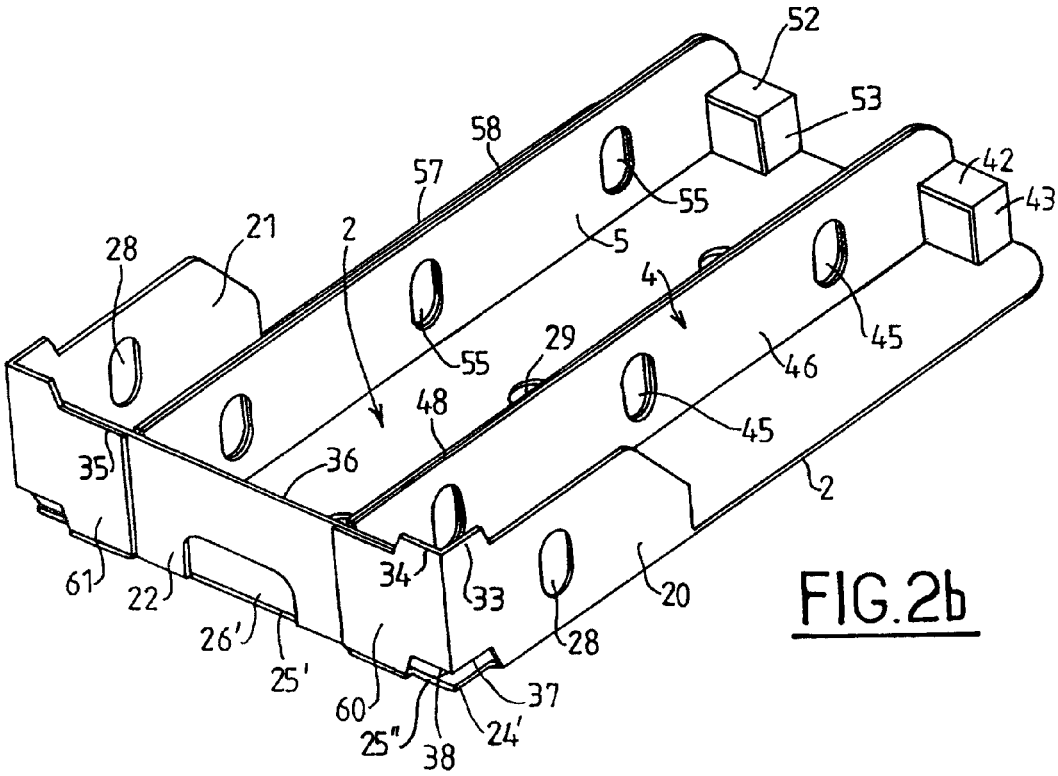

FIGS. 2*a* and 2*b* differ from FIGS. 1*a* and 1*b* by deployed retaining elements with two retaining flaps 42 and 43 and also 52 and 53 (FIG. 2*c*) obtained by cutouts at 44' and 44", and at 54' and 54" that are deployed to form two flaps 42 and 43 at 90° and also to form two flaps 52 and 53 at 90° that can easily be torn off. These optional retaining elements 52 and 53 are preferably disposed close to the front edge 25 as shown so as to make them easier to tear off or fold away when putting the trays on a shelf, or indeed they may be located in a gap 74 between two products. They can be obtained merely by providing pre-cuts in a card blank.

Alternatively, it is possible to use one or more retaining devices with a single deployable flap.

Figure 3A:
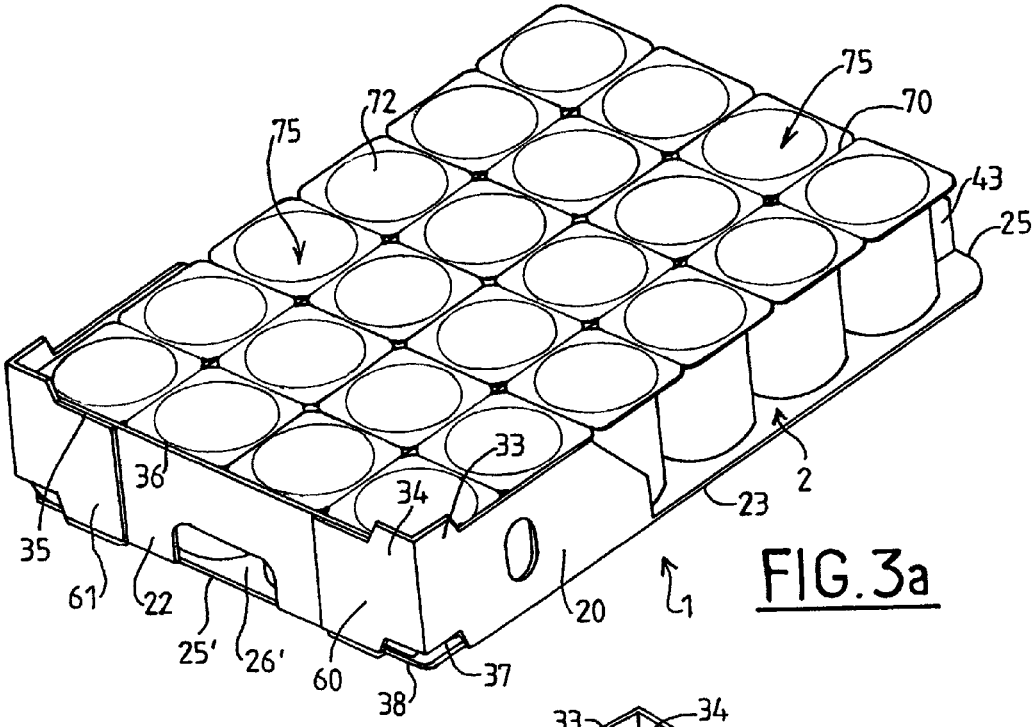
Figure 3B:
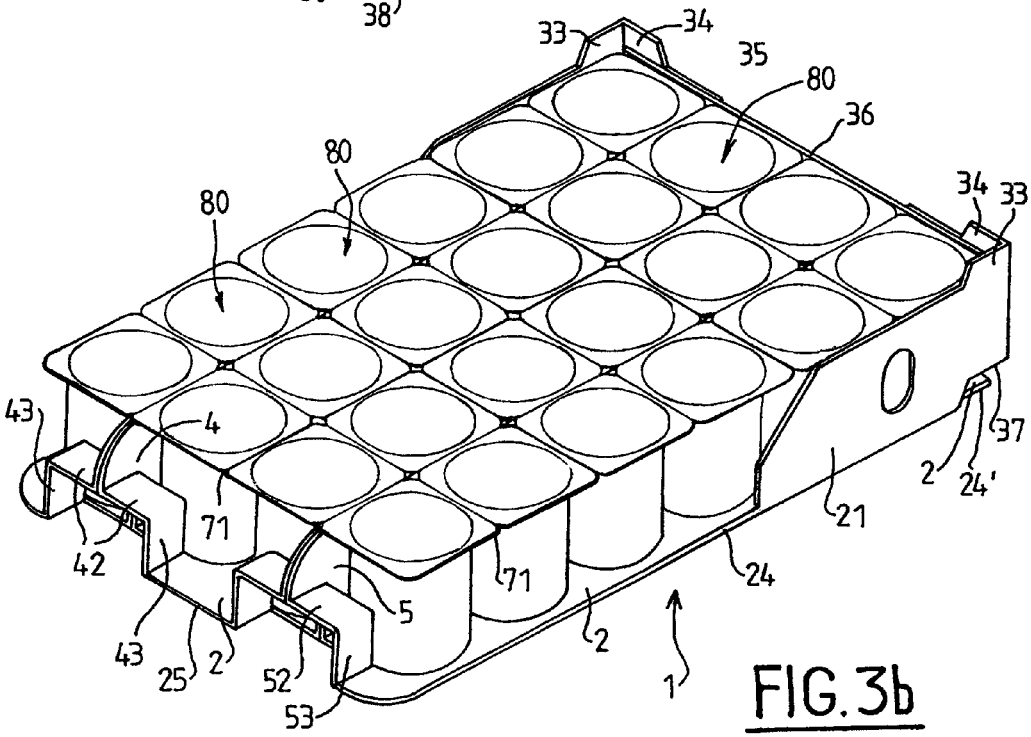

FIGS. 3*a* and 3*b* show a presentation device associating a tray as described above with yogurt pots in fours (four pack 75) in FIG. 3*a*, and in eights (reference 80) in FIG. 3*b*.

Figure 4A:
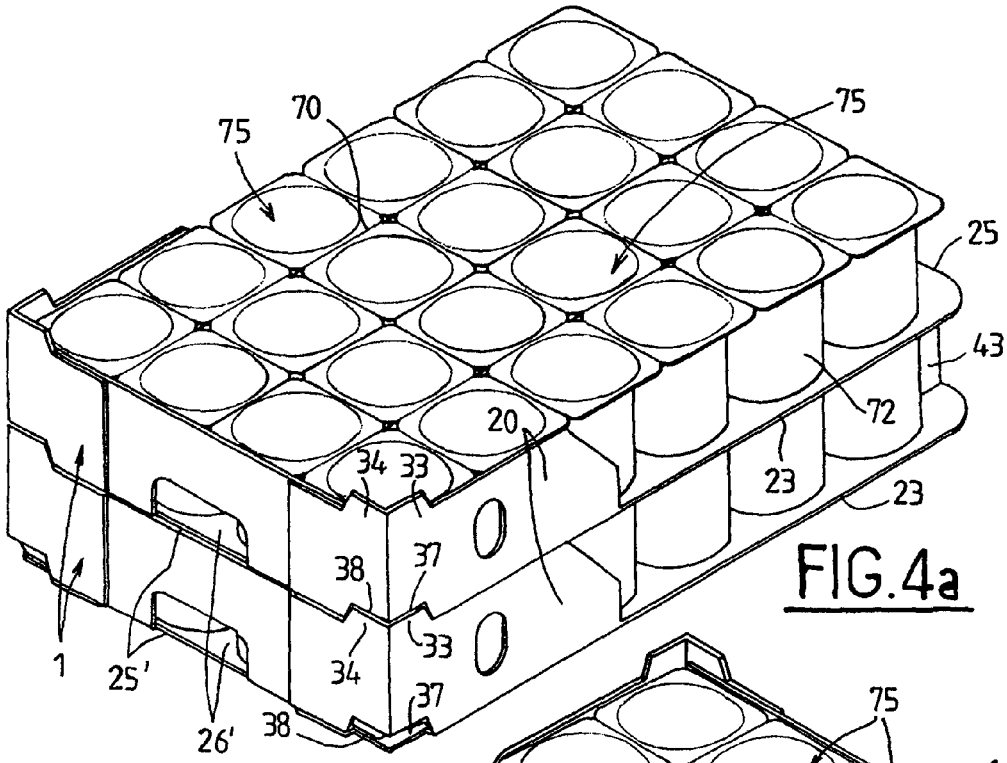
Figure 4B:
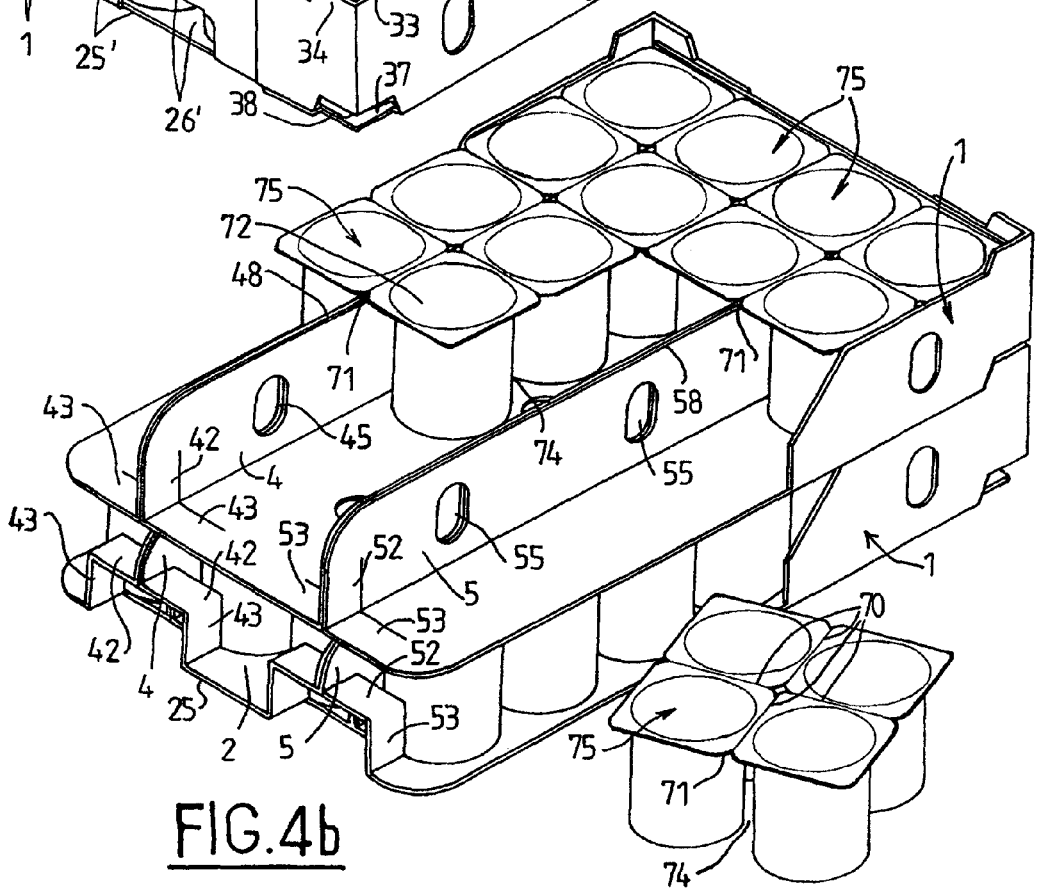
Figure 4C:
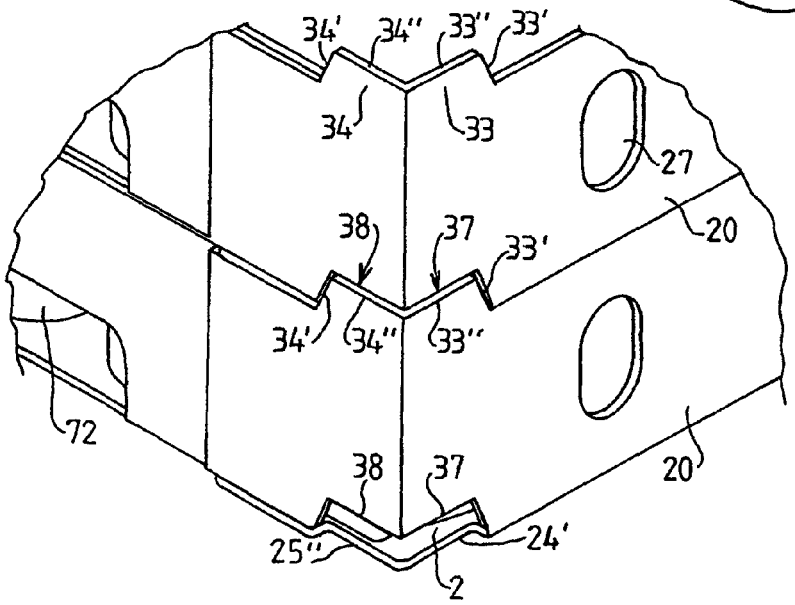

FIGS. 4*c* and 4*b* show the presentation devices stacked in superposition with mutual engagement via the trapezoid cutouts 37 and 38 and the raised extensions 33 and 34 (see FIG. 4*c*).

Figure 5:
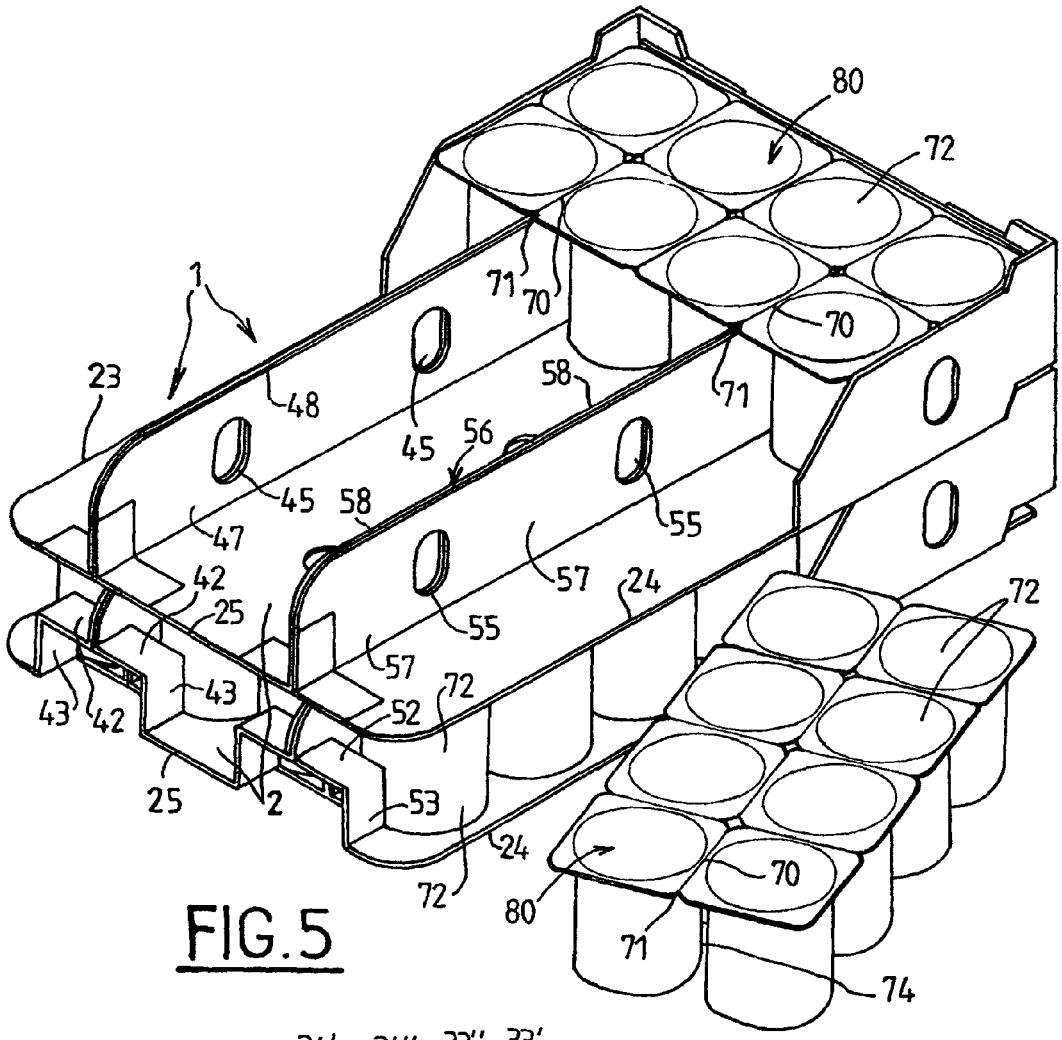
FIG. 5 is a front perspective view showing two presentation devices of FIG. 2*b* in superposition, with two groups of 8 pots removed.

In FIG. 4*b*, it can be seen more particularly that the yogurt pots 72 are placed astride the walls 4 and 5, with two pots in a four pack 75 being disposed on each side of a wall. FIG. 5 shows that yogurts in eights (referenced 80) can be arranged either lengthwise or crosswise relative to the tray.

The height of the separator walls 4 and 5 is selected so that their top faces 48 and 58 come substantially into contact with the bottom faces 71 of the bridge regions 70 between the pots 72. As a result, given that the separator walls 4 and 5 are situated between pots that are connected together (and not at the periphery of the tray as in the prior art), the force exerted on the pots is greatly decreased, and the force can be transmitted for the most part by the walls 4 and 5 while making up pallets that have a nominal height that is generally about 2 meters.

This makes it possible significantly to reduce the thickness of the yogurt pot walls, e.g. in the range about 0.7 millimeters (mm) to 0.8 mm, thereby saving material.

A small gap (e.g. 1 mm) may exist between the bottom faces 71 of the bridge regions 70 and the top faces 48 and 58 of the walls 4 and 5. Under the action of a force exerted on an upper tray, the pots situated on either side of a wall 4 or 5 tend to bend, moving a little away from each other until said bottom face 71 comes into abutment against the top edge 48 or 58 of the wall 4 or 5, thereby essentially taking up the force.

In addition, as mentioned above, the presentation device, which is designed for placing on a shelf, eliminates or significantly reduces the card sleeves in which the pots are wrapped and that are taken home by consumers, thereby giving rise to the above-mentioned recycling problems for which an eco-tax is raised.

The device as described presents advantages for putting on shelves.

Because the front face 25 and major fractions of the length of the sides 23 and 24 do not have any wall, the products are shown off, which means that eliminating the card sleeves is not a drawback in terms of presenting the products on a shelf. The tray may carry printing that becomes uncovered as products are taken away by clients.

The side flaps 20 and 21 and the folded flaps 60 and 61 reinforce the rear portion of the tray and enable it to be gripped without problem for handling and putting on a shelf.

The absence of a wall over the major fraction of the outline of the tray facilitates air flow when the products are passed through a cooling tunnel. This flow is made easier by the presence of the cutouts 26' and/or 27 and/or 28 and/or 29 and/or 45 and/or 55.

The mechanical function of the longitudinal walls 4 and 5 having the products placed astride them is reinforced when they are made by folding two panels 46 and 47 or 56 and 57 against one another with top edges respectively 48 and 58 serving as supports for the bridge regions 71 between the pots 72 or between rows of pots that are secured to one another.

Figure 6:
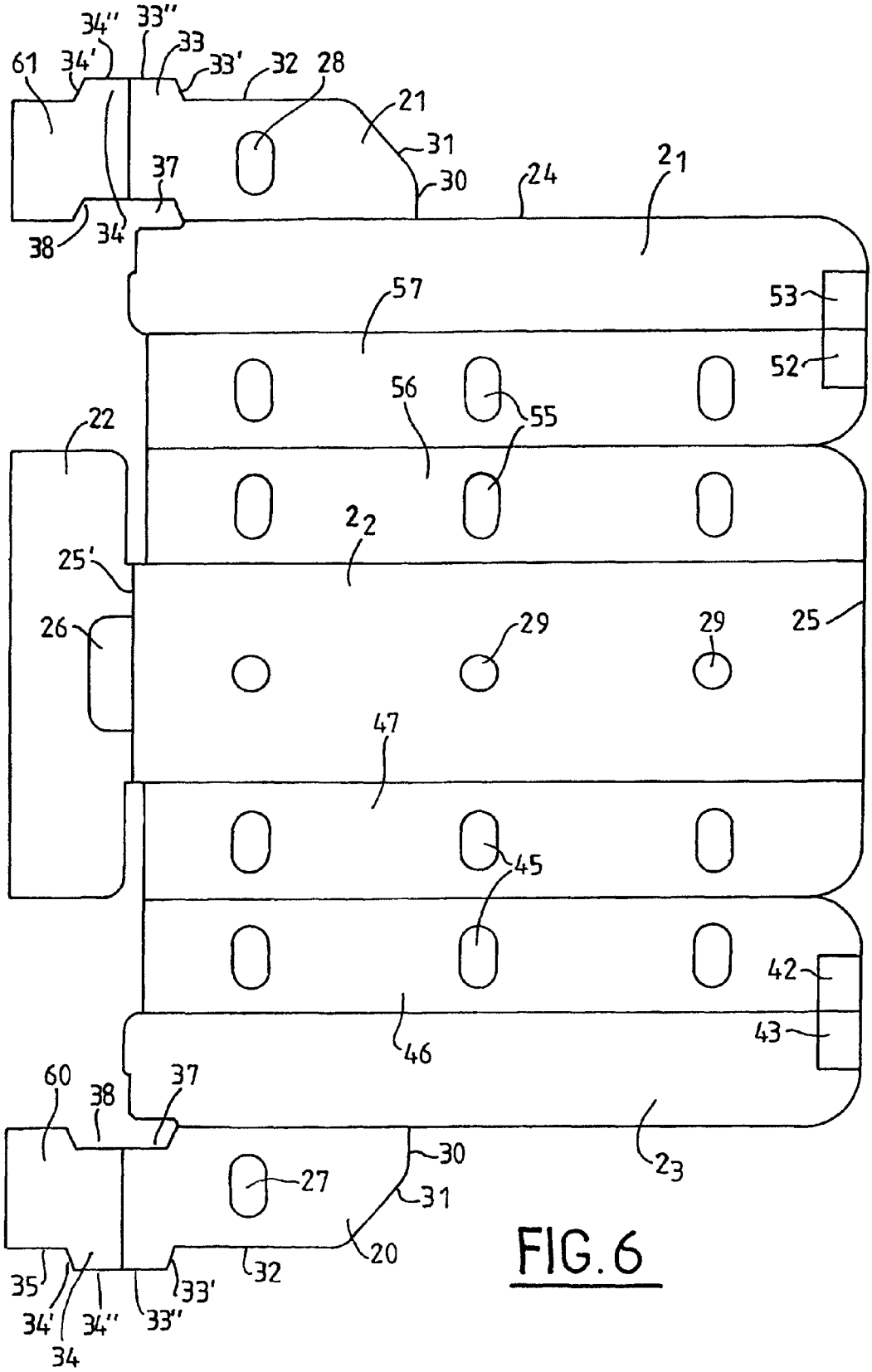
FIG. 6 is a plan view of a blank for making a tray of the preceding figures.

The tray 2 may be made from a card blank as shown in FIG. 6.

The walls 4 and 5 are formed by folding and gluing together panels 46 and 47 and panels 56 and 57. As a result, the material constituting the walls 4 and 5 and providing resistance to vertical compression is secured to the bottom of the device, and that favors good transmission of forces and good strength for the assembly.

The folding of the flaps 20 and 21 forming the side panels and the folding of the bottom flap 22 is followed by folding the flaps 60 and 61 of the side panels 20 and 21.

Figure 7A:
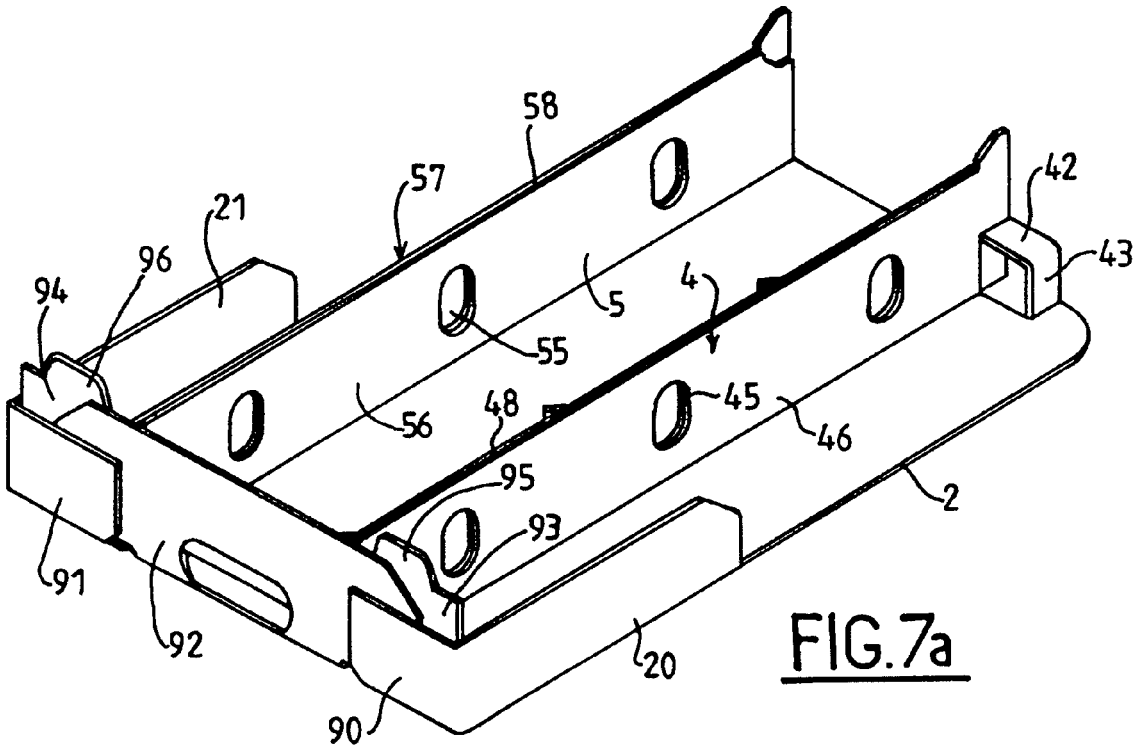
FIGS. 7*a* and 7*b* show a variant respectively of a presentation device and of a blank for making it.
Figure 7B:
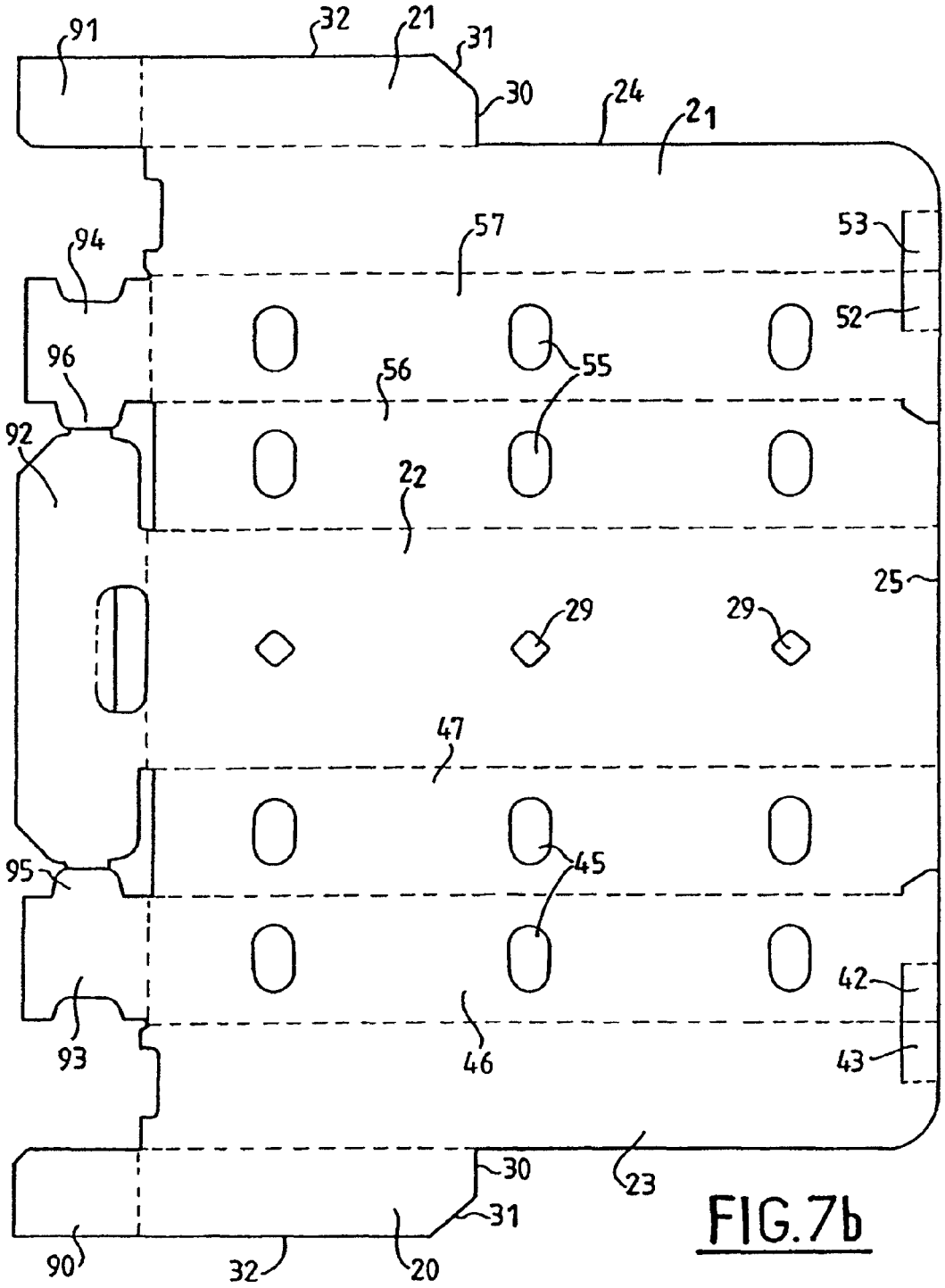

The device shown in FIGS. 7*a* and 7*b* has two additional flaps 93 and 94 that are hinged to the rear edge of one of the panels (46, 47; 56, 57) that are folded together to form the longitudinal walls 4 and 5. The rear portion of the presentation device then presents the central flap 92, the above-mentioned flaps 93 and 94, and the flaps 90 and 91 that extend the side flaps 20 and 21. In the example shown, the flaps 93 and 94 are hinged to the rear edges of the panels 46 and 57 respectively. As shown in FIG. 7*a*, partial overlap is obtained at both ends of the central flap 92 with the flaps 90 and 95 at one end and the flaps 91 and 94 at the other, thereby forming triple thicknesses that reinforce the device in this region and allow it to be handled.

As shown in FIG. 7*b*, the blank is inscribed within a rectangle of optimized outline with minimum loss of material.

The invention claimed is:

1. A system, comprising:

at least two pots secured to each other at upper portions of the at least two pots via a connection region on each of the two pots; and a tray formed of a blank, the tray including a bottom, and at least one separator wall formed from two regions of the blank folded together against each other, edge to edge, and at 90°, a top edge of the separator wall supporting the two pots via direct contact with a bottom face of the connection region of the two pots, which are situated on opposite sides of the separator wall, the top edge connecting together the two regions, and a height of the separator wall being at least equal to a height of the two pots under the connection region.

2. The system according to claim 1, comprising at least two separator walls spaced apart by a distance corresponding to a width of two adjacent pots.

3. The system according to claim 1, further comprising a plurality of pots, wherein the plurality of pots are grouped together in groups of two, four, six, or eight pots that are disposed in at least one row of the tray.

4. The system according to claim 3, wherein the tray is formed of a single blank, or of a card blank.

5. The system according to claim 1, wherein the at least one separator wall extends from a front edge of the blank to a rear edge of the blank.

6. The system according to claim 1, wherein the bottom of the tray is adjacent to a first retaining wall configured to hold the products, the first retaining wall being disposed along a first side of the bottom.

7. The system according to claim 6, further comprising second and third retaining walls extending, respectively, over fractions of second and third sides of the bottom adjacent to the first side.

8. The system according to claim 7, wherein the second and third retaining walls extend over less than half a length of the second and third sides, or extend over one-third of the length.

9. The system according to claim 7, wherein the first retaining wall is formed by folding a first flap of the bottom of the tray, and wherein the second and third retaining walls are formed by folding second and third flaps, respectively, which are hinged to the second and third sides of the bottom of the tray, respectively, and by folding respective second and third backing flaps partially overlying the first flap.

10. The system according to claim 9, further comprising at least one support flap hinged to the at least one separator wall, the at least one support flap bearing against the first retaining wall.

11. The system according to claim 7, wherein at least one of the second and third retaining walls includes an extension and a cutout that are complementary and that cooperate when the products are stacked in superposition.

12. The system according to claim 1, further comprising at least one product retaining element including at least one deployable flap in a vicinity of a front edge of the tray.

13. The system according to claim 1, wherein at least the bottom of the tray and the at least one separator wall include openings so as to facilitate air flow.

14. A system, comprising:

at least two products secured to each other via a connection region of the at least two products disposed between upper portions of the products, and a tray that is formed of a blank and accommodates the two products thereon, the tray including a bottom, and at least one separator wall formed from two regions of the blank folded together against each other, the at least one separator wall having a height such that a bottom face of the connection region between the two products rests in direct contact with a top edge of the separator wall when the two products are disposed on opposite sides of the separator wall, and the top edge connecting together the two regions.

15. The system according to claim 14, wherein the connection region between the at least two products is not part of the tray.

16. The system according to claim 1, wherein the connection region between the at least two pots is not part of the tray.

17. The system according to claim 1, wherein the at least one separator wall rises with respect to the bottom of the tray and is integrally connected to the bottom.

* * * * *